US010458674B2

(12) United States Patent
Kojima

(10) Patent No.: US 10,458,674 B2
(45) Date of Patent: Oct. 29, 2019

(54) DECORATIVE PANEL AND AIR-CONDITIONER INDOOR UNIT PROVIDED WITH SAME

(71) Applicant: DAIKIN INDUSTRIES LTD., Osaka-shi, Osaka (JP)

(72) Inventor: Nobuyuki Kojima, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 292 days.

(21) Appl. No.: 14/888,047

(22) PCT Filed: Apr. 8, 2014

(86) PCT No.: PCT/JP2014/002012
§ 371 (c)(1),
(2) Date: Oct. 29, 2015

(87) PCT Pub. No.: WO2014/178169
PCT Pub. Date: Nov. 6, 2014

(65) Prior Publication Data

US 2016/0076790 A1 Mar. 17, 2016

(30) Foreign Application Priority Data

Apr. 30, 2013 (JP) ..... 2013-095518

(51) Int. Cl.
*F24F 13/20* (2006.01)
*F24F 1/00* (2019.01)
(Continued)

(52) U.S. Cl.
CPC ..... *F24F 13/20* (2013.01); *F24F 1/0014* (2013.01); *F24F 1/0047* (2019.02); *F24F 2013/0616* (2013.01)

(58) Field of Classification Search
CPC combination set(s) only.
See application file for complete search history.

(56) References Cited

U.S. PATENT DOCUMENTS 6,141,983 A * 11/2000 Nishikawa ..... F24F 1/0011 165/53
6,450,880 B1 * 9/2002 Asahina ..... F24F 1/0011 454/233
(Continued)

FOREIGN PATENT DOCUMENTS

CN 1771414 A 5/2006
EP 1688677 A1 8/2006
(Continued)

OTHER PUBLICATIONS

JP2010043783MT; machine translation of JP2010043783A.*
(Continued)

*Primary Examiner* — Gregory L Huson
*Assistant Examiner* — Elizabeth M. May
(74) *Attorney, Agent, or Firm* — Birch, Stewart, Kolasch & Birch, LLP

(57) ABSTRACT

A decorative panel includes a panel body with a suction port and an outlet port, and a suction grill attached to the suction port of the panel body. The suction grill includes a grill body positioned over the suction port, and an extension extending outward from the entire periphery of the grill body to overlap with a lower surface of the panel body. The extension is configured such that an end of a portion of the extension extending toward the outlet port is located closer to the suction port than an edge of the lower surface of the panel body facing the outlet port.

15 Claims, 7 Drawing Sheets

(51) Int. Cl.

| | |
|---|---|
| ***F24F 1/0047*** | (2019.01) |
| ***F24F 1/0014*** | (2019.01) |
| *F24F 13/06* | (2006.01) |

(56) References Cited

U.S. PATENT DOCUMENTS

| | | | | |
|---|---|---|---|---|
| 6,551,185 | B1 | 4/2003 | Miyake et al. | |
| 2006/0213216 | A1 | 9/2006 | Sakashita et al. | |
| 2009/0013711 | A1 | 1/2009 | Sakashita et al. | |
| 2011/0120170 | A1* | 5/2011 | Sakashita ..... | B01D 46/0065 62/426 |

FOREIGN PATENT DOCUMENTS

| | | | | |
|---|---|---|---|---|
| JP | 06-193902 | A | | 7/1994 |
| JP | 10-220796 | A | | 8/1998 |
| JP | 2010-043783 | A | | 2/2010 |
| JP | 2010043783 | A | * | 2/2010 |
| JP | 2011-133190 | A | | 7/2011 |

OTHER PUBLICATIONS

BASF Frequently Asked Questions, URL http://www.spf.basf.com/faq.php, Accessed Apr. 5, 2018, Published date Feb. 28, 2012.*

International Search Report issued in PCT/JP2014/002012 dated Jul. 15, 2014.

* cited by examiner

DECORATIVE PANEL AND AIR-CONDITIONER INDOOR UNIT PROVIDED WITH SAME

TECHNICAL FIELD

The present invention relates to a decorative panel for a ceiling-mounted indoor unit of an air conditioning device, and an indoor unit for an air conditioning device including the decorative panel.

BACKGROUND ART

Ceiling mounted indoor units mounted on the ceiling of a room have been used as indoor units for air conditioning devices. An indoor unit of this type includes an indoor unit body including an indoor heat exchanger and a blower fan that are housed in a casing having an opened bottom, and a decorative panel attached to the bottom of the indoor unit body.

In this indoor unit, the decorative panel includes a panel body with a suction port and an outlet port, and a suction grill fitted in the suction port of the panel body.

CITATION LIST

Patent Document

Patent Document 1: Japanese Unexamined Patent Publication No. 2011-133190

SUMMARY OF THE INVENTION

Technical Problem

However, if the suction grill is configured to be fitted in the suction port of the panel body as described above, a gap (a seam) is left between a portion of the panel body surrounding the suction port and the suction grill, which impairs the design of the panel. Such a seam may be eliminated by, for example, making the suction grill larger than the suction port such that the suction grill is attached to the bottom of the panel body instead of fitting the suction grill in the suction port of the panel body. However, since the outlet port is arranged around the suction port of the panel body, an outer periphery of the suction grill may reach the outlet port if the size of the suction grill is increased too much. This may possibly cause the cooling air blown through the outlet port during cooling operation to condense on the outer periphery of the suction grill.

In view of the foregoing, it is therefore an object of the present invention to improve the design of a suction grill of a decorative panel for an indoor unit of an air conditioning device to be mounted on a ceiling, and to reduce condensation on the suction grill.

Solution to the Problem

A first aspect of the invention is a decorative panel for an air conditioning device attached to a bottom of an indoor unit body (21) mounted on a ceiling. The decorative panel includes: a panel body (41) having a suction port (42*a*) and an outlet port (43*a*); and a suction grill (60) attached to the suction port (42*a*) of the panel body (41). The suction grill (60) includes a grill body (61) positioned over the suction port (42*a*), and an extension (65) configured to extend outward from an entire periphery of the grill body (61) to overlap with a lower surface of the panel body (41) such that an end (65*a*) of a portion of the extension (65) extending toward the outlet port (43*a*) is located closer to the suction port (42*a*) than an edge (46*a*) of the lower surface of the panel body (41) facing the outlet port (43*a*).

According to the first aspect of the invention, the suction grill (60) includes the grill body (61) positioned over the suction port (42*a*) and the extension (65) extending outward from the entire circumference of the grill body (61) to overlap with the lower surface of the panel body (41). The suction grill (60) is arranged to cover a lower end of the suction port (42*a*) without being fitted in the suction port (42*a*). Thus, unlike the configuration in which the suction grill (60) is fitted in the suction port (42*a*), no seam is left between them (60, 42*a*). Further, the extension (65) of the suction grill (60) is configured such that the end (65*a*) of a portion of the extension (65) extending toward the outlet port (43*a*) (hereinafter simply referred to as an "outlet-side end (65*a*) of the extension (65)") is located closer to the suction port (42*a*) than an edge (46*a*) of the lower surface of the panel body (41) facing the outlet port (43*a*). Thus, during a cooling operation, cooling air blown out through the outlet port (43*a*) is not blown against the outlet-side end (65*a*) of the extension (65). That is to say, this decorative panel is configured such that the outlet-side end (65*a*) of the extension (65) is not cooled by the cooling air during the cooling operation.

A second aspect of the invention is an embodiment of the first aspect of the invention. In the second aspect, the panel body (41) includes a heat insulator (46) which is positioned between the suction port (42*a*) and the outlet port (43*a*) and forms part of the outlet port (43*a*). The extension (65) is configured such that the end (65*a*) of the portion extending toward the outlet port (43*a*) is in contact with a lower surface of the heat insulator (46).

According to the second aspect of the invention, the extension (65) of the suction grill (60) is configured such that the outlet-side end (65*a*) of the extension (65) is in contact with a lower surface of the heat insulator (46) which forms part of the outlet port (43*a*). The heat insulator (46) thus provided between the outlet-side end (65*a*) of the extension (65) and the outlet port (43*a*) blocks heat transfer between the outlet-side end (65*a*) of the extension (65) and cooling air passing through the outlet port (43*a*). That is to say, this decorative panel is configured such that the outlet-side end (65*a*) of the extension (65) is not cooled by the cooling air during the cooling operation. Further, the extension (65) is configured such that the outlet-side end (65*a*) of the extension (65) is in contact with the lower surface of the heat insulator (46) which forms part of the outlet port (43*a*), and is located closer to the suction port (42*a*) than the edge (46*a*) facing the outlet port (43*a*). In this configuration, the outlet-side end (65*a*) of the extension (65) is provided at a position near the outlet port (43*a*) toward which the blowout air is not blown, thereby bringing an outline of the suction grill (60) closer to an outline of the outlet port (43*a*).

A third aspect of the invention is an embodiment of the second aspect of the invention. In the third aspect, a water-absorbing material which absorbs water is fixed onto the lower surface of the heat insulator (46).

According to the third aspect of the invention, a water-absorbing material which absorbs water is fixed onto the lower surface of the heat insulator (46) which the outlet-side end (65*a*) of the extension (65) of the suction grill (60) is in contact with. Thus, even if condensation occurred near the outlet port (43*a*), condensed water would be absorbed by the water-absorbing material, and thus would neither permeate the heat insulator (46) nor form a drop onto the outlet-side end (65*a*) of the extension (65).

A fourth aspect of the invention is an embodiment of any one of the first to third aspects of the invention. In the fourth aspect, a regulating portion (70) which regulates a flow of air from the outlet port (43*a*) toward the suction port (42*a*) is provided between an upper surface of the extension (65) and the lower surface of the panel body (41).

As can be seen from the above description, if the suction grill (60) provided with an extension (65) that overlaps with the lower surface of the panel body (41) is arranged to cover the lower end of the suction port (42*a*) instead of fitting the suction grill (60) in the suction port (42*a*), part of the air blown out through the outlet port (43*a*) may possibly flow into the suction port (42*a*) through the gap left between the lower surface of the panel body (41) and the extension (65) of the suction grill (60) without being supplied into the room.

According to the fourth aspect of the invention, however, the regulating portion (70) is provided between the upper surface of the extension (65) of the suction grill (60) and the lower surface of the panel body (41). Thus, the regulating portion (70) regulates the flow of the air from the outlet port (43*a*) toward the suction port (42*a*).

A fifth aspect of the invention is an embodiment of the fourth aspect of the invention. In the fifth aspect, the regulating portion (70) is comprised of a groove (71) cut in the lower surface of the panel body (41) to extend along the outlet port (43*a*), and a protruding wall (72) protruding from the upper surface of the extension (65) into the groove (71) to extend in a longitudinal direction of the groove (71).

According to the fifth aspect of the invention, even if part of the air blown out through the outlet port (43*a*) flowed into the gap between the upper surface of the extension (65) of the suction grill (60) and the lower surface of the panel body (41), the air would collide against the protruding wall (72) standing in the groove (71) and would stagnate there. In this manner, the flow of the air from the outlet port (43*a*) toward the suction port (42*a*) is regulated.

A sixth aspect of the invention is an indoor unit for an air conditioning device. The indoor unit includes an indoor unit body (21) mounted on a ceiling, and a decorative panel (40) attached to a bottom of the indoor unit body (21). The decorative panel (40) is configured as the decorative panel according to any one of the first to fifth aspects of the invention.

According to the sixth aspect of the invention, in the indoor unit for an air conditioning device including the indoor unit body (21) and the decorative panel (40), the decorative panel (40) is configured as the decorative panel of any one of the first to fifth aspects of the invention including a suction grill which allows for improving the design of the suction grill and reducing condensation on the suction grill.

Advantages of the Invention

According to the first aspect of the invention, the suction grill (60) is provided with an extension (65) extending outward from the entire periphery of a grill body (61), which is positioned over a suction port (42*a*), so as to overlap with the lower surface of the panel body (41). This allows for easy provision of a suction grill (60) with improved design without leaving any seam. Further, the extension (65) of the suction grill (60) is configured such that the outlet-side end (65*a*) of the extension (65) is located closer to the suction port (42*a*) than the edge (46*a*) of the lower surface of the panel body (41) facing the outlet port (43*a*). Thus, cooling air blown out through the outlet port (43*a*) is not blown against the outlet-side end (65*a*) of the extension (65), and thus the outlet-side end (65*a*) of the extension (65) is not cooled by the cooling air. This allows for reducing condensation on the outer periphery of the suction grill (60).

According to the second aspect of the invention, the extension (65) of the suction grill (60) is configured such that the outlet-side end (65*a*) of the extension (65) is in contact with the lower surface of the heat insulator (46) which forms part of the outlet port (43*a*). Thus, the heat insulator (46) blocks heat transfer between the outlet-side end (65*a*) of the extension (65) and cooling air passing through the outlet port (43*a*), thereby preventing the cooling air from cooling the outlet-side end (65*a*) of the extension (65) too much. This allows for further reducing the condensation on the outer periphery of the suction grill (60). In addition, since the extension (65) is configured such that the outlet-side end (65*a*) of the extension (65) is located rather close to the outlet port (43*a*) to bring an outline of the suction grill (60) closer to an outline of the outlet port (43*a*), the outline of the suction grill (60) turns into an inconspicuous one. This allows for further design improvement.

According to the third aspect of the invention, the water-absorbing material which absorbs water is fixed onto the lower surface of the heat insulator (46). Thus, even if condensation occurred near the outlet port (43*a*), the water-absorbing material absorbs condensed water, thereby preventing the condensed water from permeating the heat insulator (46), and from forming a drop on the outlet-side end (65*a*) of the extension (65).

According to the fourth aspect of the invention, a regulating portion (70) which regulates the flow of air from the outlet port (43*a*) toward the suction port (42*a*) is provided between the upper surface of the extension (65) of the suction grill (60) and the lower surface of the panel body (41). This allows for preventing part of the air blown out through the outlet port (43*a*) from flowing into the suction port (42*a*) without being supplied into the room. As a result, decrease in the efficiency of the indoor unit including the decorative panel with the above-described configuration is minimized.

According to the fifth aspect of the invention, the regulating portion (70) is comprised of the groove (71) cut in the lower surface of the panel body (41) to extend along the outlet port (43*a*), and the protruding wall (72) protruding from the upper surface of the extension (65) into the groove (71) and extending in the longitudinal direction of the groove (71). This simple configuration allows for preventing part of the air blown out through the outlet port (43*a*) from flowing into the suction port (42*a*) without being supplied into the room.

According to the sixth aspect of the invention, provided is an indoor unit for an air conditioning device including the decorative panel (40) which allows for improving the design of the suction grill and reducing condensation on the suction grill.

DESCRIPTION OF EMBODIMENTS

Embodiments of the present invention will be described in detail with reference to the drawings. The following description of embodiments is merely an illustrative one in nature, and does not intend to limit the scope of the present invention or applications or uses thereof.

(Air Conditioning Device)

Figure 1:
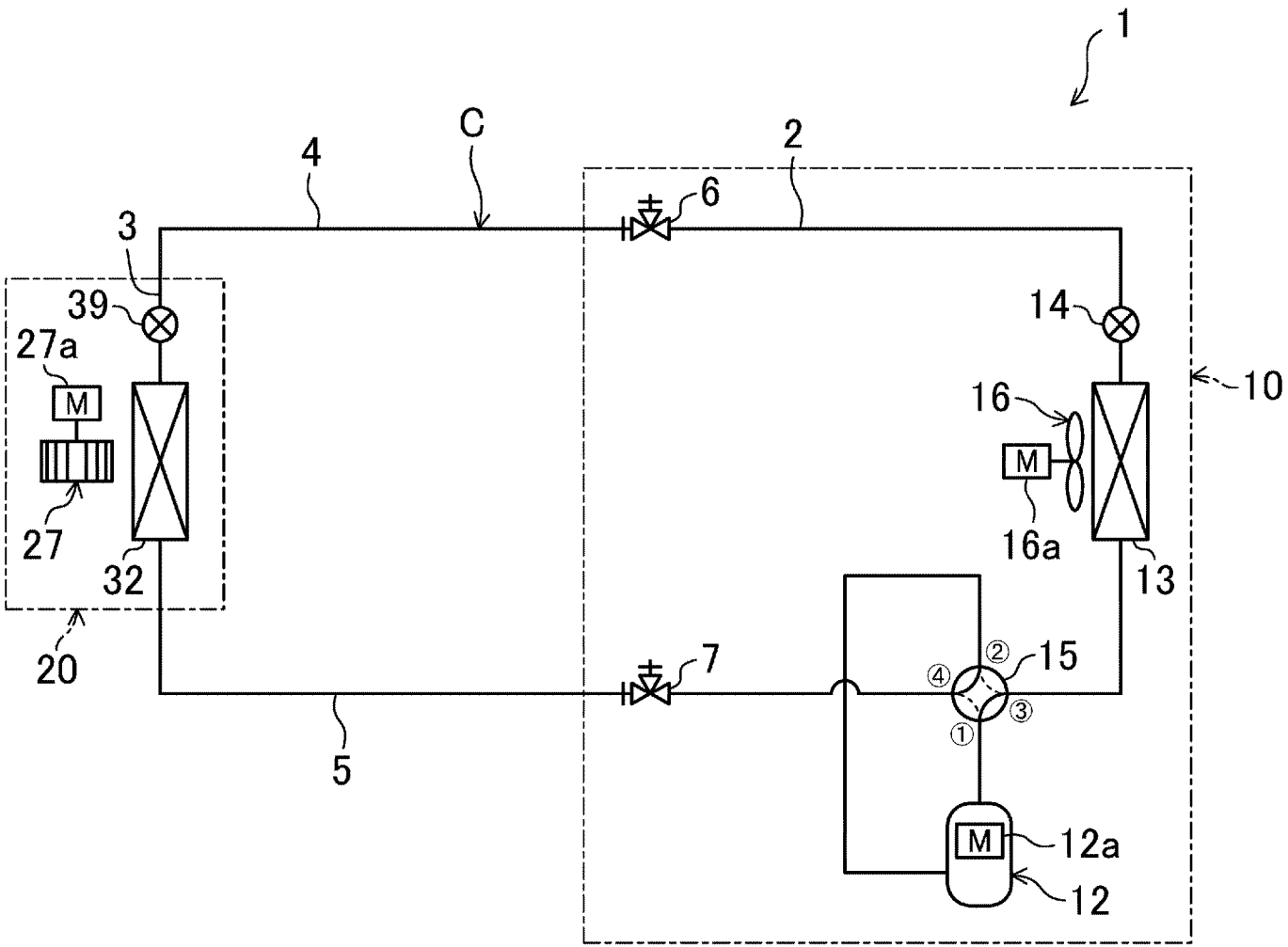
FIG. 1 is a general piping diagram illustrating a configuration for a refrigerant circuit for an air conditioning device according to an embodiment.

An embodiment of the present invention is an air conditioning device (1) configured to cool and heat indoor air. As illustrated in FIG. 1, the air conditioning device (1) includes an outdoor unit (10) installed outdoors, and an indoor unit (20) installed indoors. The outdoor unit (10) has an outdoor circuit (2) through which a refrigerant flows, and the indoor unit (20) has an indoor circuit (3) through which the refrigerant flows. The outdoor and indoor circuits (2) and (3) are connected with each other through a liquid communication pipe (4) and a gas communication pipe (5), which thus forms a refrigerant circuit (C). In the refrigerant circuit (C), a refrigerant injected therein is circulated to perform a vapor compression refrigeration cycle.

In the outdoor circuit (2) of the outdoor unit (10), connected together are a liquid-side shut-off valve (6), a gas-side shut-off valve (7), a compressor (12), an outdoor heat exchanger (13), an outdoor expansion valve (14), and a four-way switching valve (15). The liquid communication pipe (4) is connected to the liquid-side shut-off valve (6), and the gas communication pipe (5) is connected to the gas-side shut-off valve (7).

The compressor (12) compresses a low-pressure refrigerant, and discharges a high-pressure refrigerant thus compressed. In the compressor (12), a compression mechanism such as a scroll or rotary compression mechanism is driven by a compressor motor (12*a*). The compressor motor (12*a*) is configured so that the number of rotation (i.e., the operation frequency) thereof can be changed by an inverter.

The outdoor heat exchanger (13) is a fin and tube heat exchanger. An outdoor fan (16) is installed near the outdoor heat exchanger (13). In the outdoor heat exchanger (13), the air carried by the outdoor fan (16) exchanges heat with a refrigerant. The outdoor fan (16) is configured as a propeller fan driven by an outdoor fan motor (16*a*). The outdoor fan motor (16*a*) is configured so that the number of rotation thereof can be changed by an inverter.

The outdoor expansion valve (14) is configured as an electronic expansion valve, of which the degree of opening is variable. The outdoor expansion valve (14) is connected to a liquid-side end portion of the outdoor heat exchanger (13) and the liquid-side shut-off valve (6).

The four-way switching valve (15) includes first to fourth ports. In the four-way switching valve (15), the first port is connected to a discharge side of the compressor (12), the second port is connected to a suction side of the compressor (12), the third port is connected to a gas-side end portion of the outdoor heat exchanger (13), and the fourth port is connected to the gas-side shut-off valve (7). The four-way switching valve (15) is switchable between a first state (a state indicated by the solid curves in FIG. 1) and a second state (a state indicated by the broken curves in FIG. 1). In the four-way switching valve (15) in the first state, the first port communicates with the third port, and the second port communicates with the fourth port. In the four-way switching valve (15) in the second state, the first port communicates with the fourth port, and the second port communicates with the third port.

An indoor heat exchanger (32) and an indoor expansion valve (39) are connected together in the indoor circuit (3) of the indoor unit (20).

The indoor heat exchanger (32) is a fin and tube heat exchanger. The gas communication pipe (5) is connected to a gas-side end-portion of the indoor heat exchanger (32). The indoor expansion valve (39) is connected to a liquid-side end portion of the indoor heat exchanger (32). An indoor fan (27) is installed near the indoor heat exchanger (32). The indoor fan (27) is a centrifugal blower driven by an indoor fan motor (27*a*). The indoor fan motor (27*a*) is configured so that the number of rotation thereof can be changed by an inverter.

The indoor expansion valve (39) is configured as an electronic expansion valve, of which the degree of opening is variable. The indoor expansion valve (39) is connected to the liquid-side end portion of the indoor heat exchanger (32) and the liquid communication pipe (4).

<Operation Mechanism of Air Conditioning Device>

The air conditioning device (1) makes a switch between a cooling operation and a heating operation in the following manner.

During the cooling operation, the four-way switching valve (15) is switched to the first state (the state indicated by the solid curves in FIG. 1) to make the compressor (12), the indoor fan (27), and the outdoor fan (16) operate. Thus, the refrigerant circuit (C) performs a refrigeration cycle in which the outdoor heat exchanger (13) serves as a condenser, and the indoor heat exchanger (32) serves as an evaporator. Specifically, a high-pressure refrigerant compressed by the compressor (12) flows through the outdoor heat exchanger (13) and dissipates heat to outdoor air to condense. The condensed refrigerant has its pressure reduced by the indoor expansion valve (39) of the indoor unit (20), flows through the indoor heat exchanger (32), and absorbs heat from indoor air to evaporate. As a result, the indoor air is cooled by the refrigerant, and the air thus cooled is supplied to an indoor space (R). On the other hand, the refrigerant evaporated in the indoor heat exchanger (32) is sucked into the compressor (12) and is compressed again.

During the heating operation, the four-way switching valve (15) is switched to the second state (the state indicated by the broken curves in FIG. 1) to make the compressor (12), the indoor fan (27), and the outdoor fan (16) operate. Thus, the refrigerant circuit (C) performs a refrigeration cycle in which the indoor heat exchanger (32) serves as a condenser, and the outdoor heat exchanger (13) serves as an evaporator. Specifically, a high-pressure refrigerant compressed by the compressor (12) flows through the indoor heat exchanger (32) of the indoor unit (20) and dissipates heat to the indoor air to condense. As a result, the indoor air is heated by the refrigerant, and the air thus heated is supplied to the indoor space (R). On the other hand, the refrigerant condensed in the indoor heat exchanger (32) has its pressure reduced by the outdoor expansion valve (14) of the outdoor unit (10), and then flows through the outdoor heat exchanger (13). In the outdoor heat exchanger (13), the refrigerant absorbs heat from the outdoor air to evaporate. The refrigerant thus evaporated is sucked into the compressor (12) and is compressed again.

(Detailed Structure of Indoor Unit)

Next, a detailed structure of the indoor unit (20) of the air conditioning device (1) will be described with reference to FIGS. 2-4. The indoor unit (20) of this embodiment is configured as a ceiling mounted indoor unit, and includes an indoor unit body (21) which is fitted and attached into an opening (O) of a ceiling (U) facing the indoor space (R), and a decorative panel (40) attached to the bottom of the indoor unit body (21). In this embodiment, the indoor unit body (21) is suspended by a suspending mechanism (not shown) in a space above the ceiling (U) (i.e., a roof space). The decorative panel (40) attached to the bottom of the indoor unit body (21) closes the opening (O) of the ceiling (U) and a lower surface of the indoor unit body (21).

<Indoor Unit Body>

Figure 2:
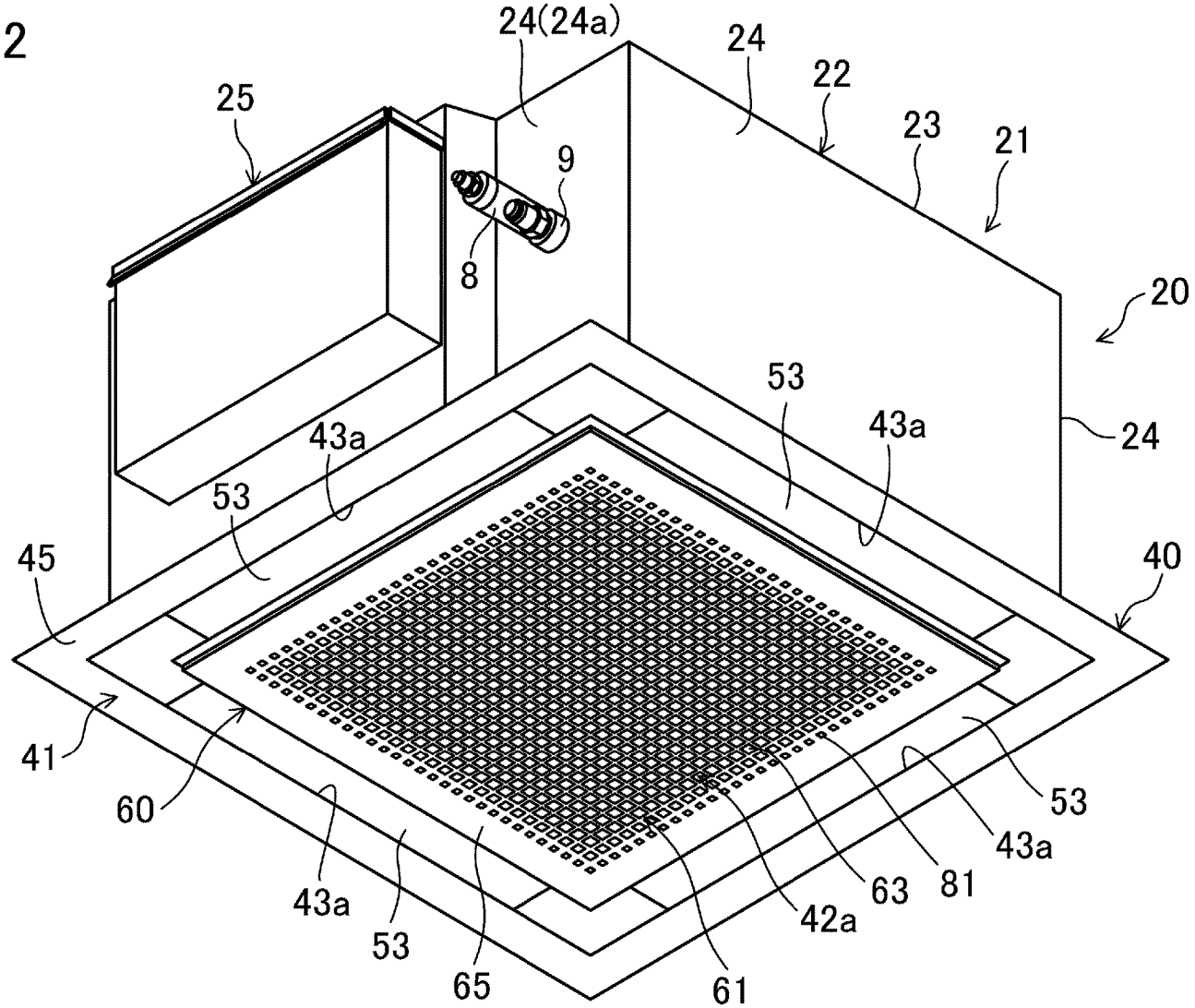
FIG. 2 is a perspective view showing the appearance of an indoor unit according to an embodiment.
Figure 3:
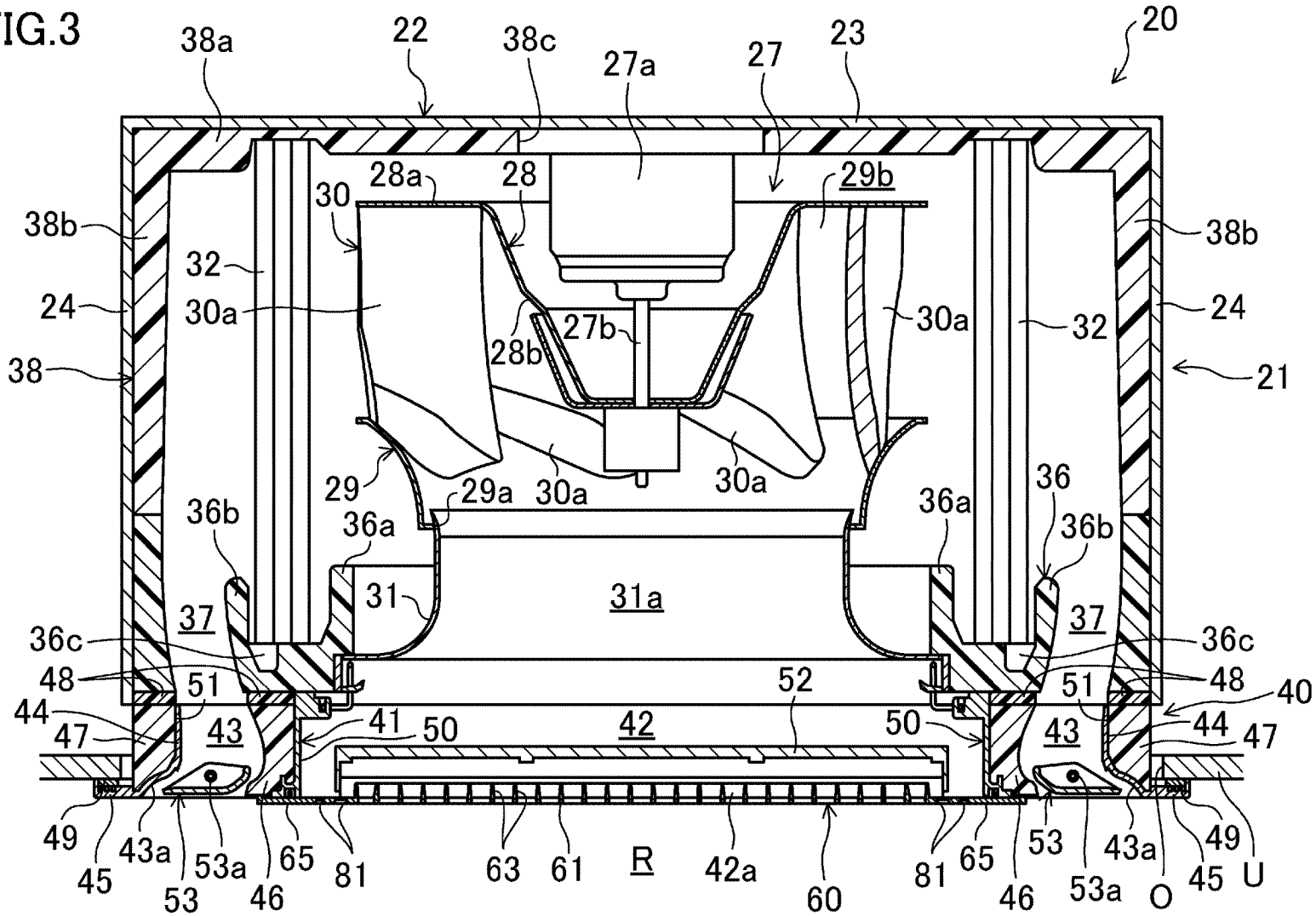
FIG. 3 is a vertical cross-sectional view showing an internal structure of an indoor unit according to an embodiment.

As illustrated in FIGS. 2 and 3, the indoor unit body (21) includes a casing (22). The casing (22) includes a top panel (23) which is generally square in a plan view and four generally rectangular side panels (24) extending downward from a peripheral portion of the top panel (23), and is configured as a box-shaped casing having a generally rectangular parallelepiped shape and an opening in its lower surface. As illustrated in FIG. 2, an elongate, box-shaped electric component box (25) is attached to a side panel (24*a*), which is one of the four side panels (24). Also, a liquid-side connecting pipe (8) and a gas-side connecting pipe (9), which are connected to the indoor heat exchanger (32), run through this side panel (24*a*). The liquid-side connecting pipe (8) is connected to the liquid communication pipe (4), and the gas-side connecting pipe (9) is connected to the gas communication pipe (5).

The casing (22) houses the indoor fan (27), a bell mouth (31), the indoor heat exchanger (32), and a drain pan (36).

Figure 4:
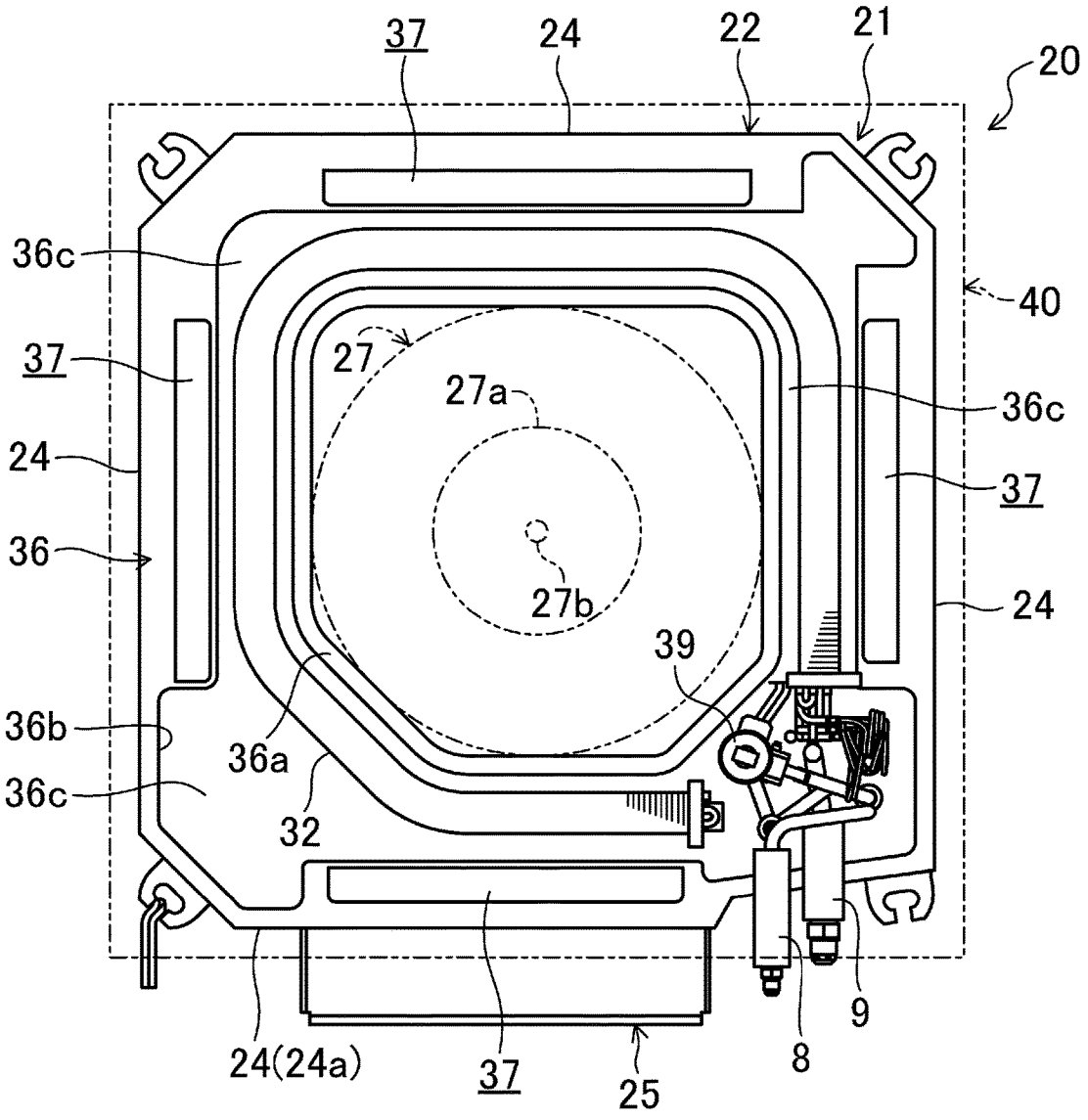
FIG. 4 is a view showing the inside of an indoor unit according to an embodiment as viewed from over a top plate.

As illustrated in FIGS. 3 and 4, the indoor fan (27) is arranged at the center inside the casing (22). The indoor fan (27) includes the indoor fan motor (27*a*), a hub (28), a shroud (29), and an impeller (30). The indoor fan motor (27*a*) is supported on the top panel (23) of the casing (22). The hub (28) is fixed to a lower end of a drive shaft (27*b*) of the indoor fan motor (27*a*) to be driven in rotation. The hub (28) includes a ringlike base (28*a*) provided radially outside of the indoor fan motor (27*a*), and a central swelling portion (28*b*) expanding downward from an inner peripheral portion of the base (28*a*).

The shroud (29) is arranged under the base (28*a*) of the hub (28) so as to face the base (28*a*). A lower portion of the shroud (29) is provided with a circular central suction port (29*a*) communicating with the inside of the bell mouth (31). The impeller (30) is housed in an impeller housing space (29*b*) between the hub (28) and the shroud (29). The impeller (30) is comprised of a plurality of turbo blades (30*a*) arranged along the rotation direction of the drive shaft (27*b*).

The bell mouth (31) is arranged under the indoor fan (27). The bell mouth (31) has a circular opening at each of its upper and lower ends, and is formed in a tubular shape so that the area of the opening increases toward the decorative panel (40). The inner space (31*a*) of the bell mouth (31) communicates with the impeller housing space (29*b*) of the indoor fan (27).

As illustrated in FIG. 4, the indoor heat exchanger (32) is provided so as to surround the indoor fan (27) by bending a refrigerant pipe (a heat transfer tube). The indoor heat exchanger (32) is installed on the upper surface of the drain pan (36) so as to stand up vertically. Air blowing laterally from the indoor fan (27) passes through the indoor heat exchanger (32). The indoor heat exchanger (32) serves as an evaporator that cools the air during a cooling operation, and also serves as a condenser (a radiator) that heats the air during a heating operation.

As illustrated in FIGS. 3 and 4, the drain pan (36) is arranged under the indoor heat exchanger (32). The drain pan (36) includes an inner wall portion (36*a*), an outer wall portion (36*b*), and a water receiving portion (36*c*). The inner wall portion (36*a*) is formed along an inner peripheral portion of the indoor heat exchanger (32), and is configured as a ringlike vertical wall that stands up vertically. The outer wall portion (36*b*) is formed along the four side panels (24) of the casing (22), and is also configured as a ringlike vertical wall that stands up vertically. The water receiving portion (36*c*) is configured as a coupling member which couples the inner and outer wall portions (36*a*) and (36*b*), and has a groove provided to collect condensed water produced in the indoor heat exchanger (32). In addition, four body-side blowout flow channels (37) extending along the four associated side panels (24) are provided to run vertically through the outer wall portion (36*b*) of the drain pan (36). Each of the body-side blowout flow channels (37) allows a downstream space of the indoor heat exchanger (32) to communicate with an associated one of four panel-side blowout flow channels (43) of the decorative panel (40) which will be described later.

Also, a body-side heat insulator (38) is further provided for the indoor unit body (21). The body-side heat insulator (38) is generally in the shape of a box with an opened bottom. The body-side heat insulator (38) includes a top panel-side heat insulating portion (38*a*) formed along the top panel (23) of the casing (22) and a side panel-side heat insulating portion (38*b*) formed along the side panels (24) of the casing (22). A central portion of the top panel-side heat insulating portion (38*a*) has a circular through hole (38*c*) that an upper end portion of the indoor fan motor (27*a*) penetrates. The side panel-side heat insulating portion (38*b*) is arranged outside the body-side blowout flow channels (37).

<Decorative Panel>

The decorative panel (40) is attached to the lower surface of the casing (22). The decorative panel (40) includes a panel body (41) and a suction grill (60).

<<Panel Body>>

As illustrated in FIGS. 2, 3, 5 and 6, the panel body (41) is configured to have a generally cubic shape which is thin in the vertical direction, and is attached to the bottom of the casing (22). The panel body (41) includes a panel-side suction channel (42), four panel-side blowout flow channels (43), and four panel-side recessed portions (44). A panel extension (45) which is generally in the shape of a frame and extends outward along the ceiling (U) is provided at a lower end of an outer peripheral portion of the panel body (41).

The panel-side suction channel (42) is formed in a center portion of the panel body (41) to penetrate the center portion of the panel body (41) vertically so as to communicate with the inner space (31*a*) of the bell mouth (31) of the indoor unit body (21). The panel-side suction channel (42) is formed inside a rectangular frame-shaped inner panel member (50) of the panel body (41). A rectangular suction port (42*a*) facing the indoor space (R) is formed at a lower end of the panel-side suction channel (42). Specifically, the panel-side suction channel (42) allows the suction port (42*a*) of the panel body (41) to communicate with the inner space (31*a*) of the bell mouth (31) of the indoor unit body (21).

Also, in the panel-side suction flow channel (42), provided is a dust collection filter (52) that catches dust in the air sucked through the suction port (42*a*).

The four panel-side blowout flow channels (43) are formed in the panel body (41) outside the panel-side suction channel (42) to surround the periphery of the panel-side suction channel (42). Specifically, each of the four panel-side blowout flow channels (43) extends along an associated one of four side portions of the panel body (41) to surround the periphery of the panel-side suction channel (42), and penetrates the associated one of the four side portions of the panel body (41) vertically to communicate with an associated one of the four body-side blowout flow channels (37) of the indoor unit body (21). Outlet ports (43*a*) facing the indoor space (R) are formed at lower ends of the four panel-side blowout flow channels (43), respectively. That is to say, the four panel-side blowout flow channels (43) allow the four outlet ports (43*a*) of the panel body (41) to respectively communicate with the four body-side blowout flow channels (37) of the indoor unit body (21).

Each of the panel-side blowout flow channels (43) is provided with an air blowing direction adjusting blade (53) to adjust the direction of the air blown out downward from above. The air blowing direction adjusting blade (53) is configured as a generally rectangular plate body extending from one end to the other of the panel-side blowout flow channel (43) in the longitudinal direction, and is arranged at the lower end of the panel-side blowout flow channel (43). The air blowing direction adjusting blade (53) includes, at each of the two ends in its longitudinal direction, a rotating shaft (53*a*) which is supported rotatably by the panel body (41). Thus, the air blowing direction adjusting blade (53) is allowed to rotate around the rotating shaft (53*a*) that serves as a shaft center.

Each of the four panel-side recessed portions (44) is formed on an associated one of the four outer side surfaces of an outer panel member (51) having a generally rectangular frame shape and defining the outer side surfaces of the four panel-side blowout flow channels (43) of the panel body (41), and is recessed from the associated one of the four outer side surfaces of the outer panel member (51) toward the associated one of the panel-side blowout flow channels (43). The length of each of the panel-side recessed portions (44) in the longitudinal direction is substantially the same as that of the panel-side blowout flow channels (43) in the longitudinal direction.

Inside the four panel-side blowout flow channels (43) (i.e., closer to the center of the panel body (41)), provided respectively are four inner heat insulating members (46). The four panel-side recessed portions (44) are provided with four outer heat insulating members (47), respectively. Further, four inner sealing members (48) are interposed between the respective upper surfaces of the four inner heat insulating members (46) and the lower surface of the drain pan (36) of the indoor unit body (21). Likewise, four inner sealing members (48) are interposed between the respective upper surfaces of the four outer heat insulating members (47) and the lower surface of the drain pan (36) of the indoor unit body (21). On the other hand, an outer sealing member (49) is interposed between an upper surface of the panel extension (45) extending outward from the lower end of the outer peripheral portion of the outer panel member (51) of the panel body (41) and the ceiling (U).

Figure 5:
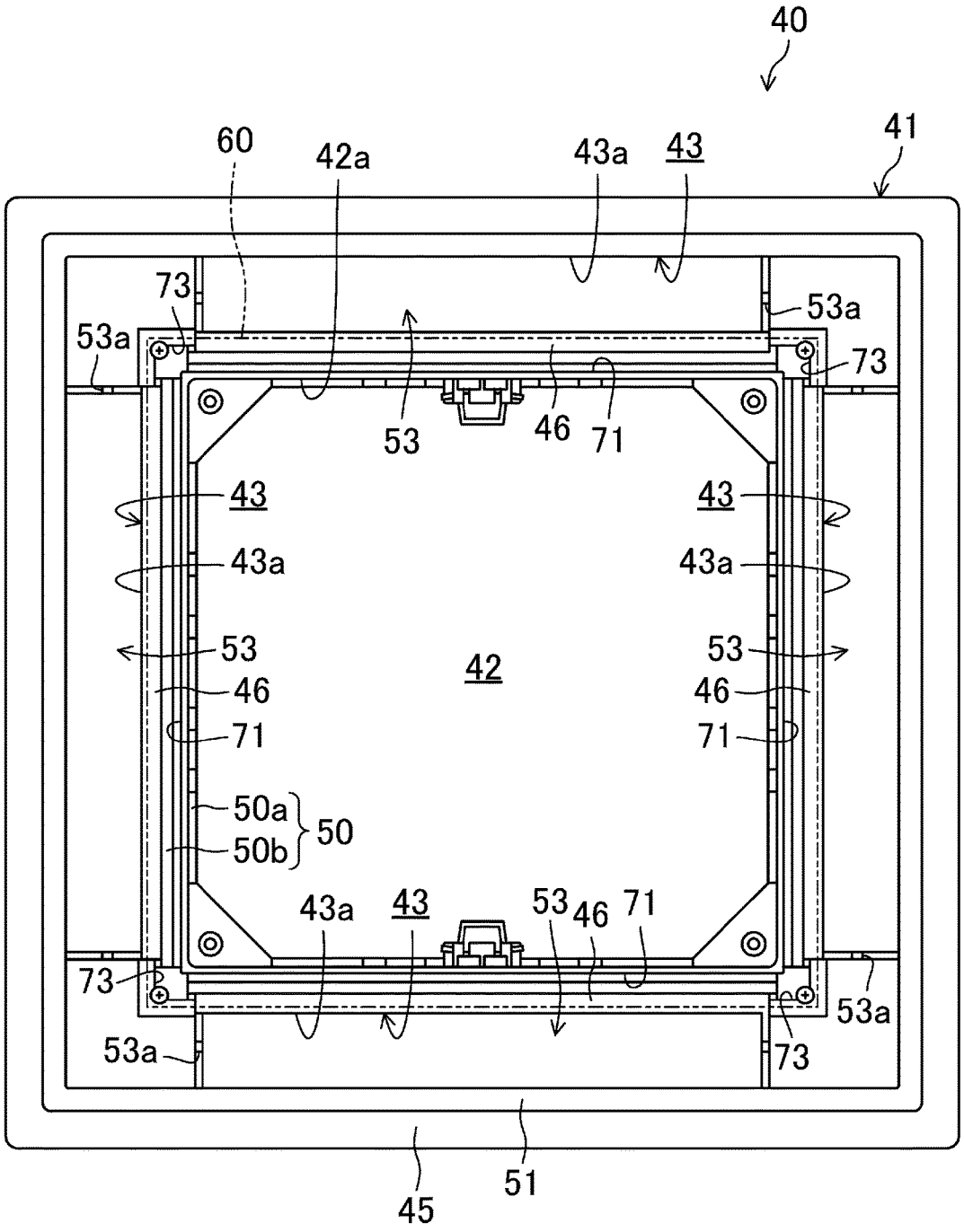
FIG. 5 is a view showing a panel body of a decorative panel according to an embodiment as viewed from an indoor space.

According to this configuration, as illustrated in FIG. 5, a generally square suction port (42*a*) is formed through the center portion of the lower surface of the panel body (41), and four outlet ports (43*a*) are formed around the suction port (42*a*) so as to respectively extend along the four sides of the suction port (42*a*). In addition, the four inner heat insulating members (46) are provided between the suction port (42*a*) of the panel body (41) and the four outlet ports (43*a*), and each of the four inner heat insulating members (46) forms part (inner peripheral portion) of an associated one of the outlet ports (43*a*).

<<Suction Grill>>

The suction grill (60) is attached to the lower end of the panel-side suction channel (42) (i.e., the suction port (42*a*)). The suction grill (60) includes a grid-shaped grill body (61) positioned over the suction port (42*a*), and an extension (65) which extends outward from the entire periphery of the lower end of the grill body (61) toward the four outlet ports (43*a*). The suction grill (60) is made of an injection-molded resin, and thus the grill body (61) and the extension (65) are integrated with each other. The color of the suction grill (60) has lightness that is high enough for a human being to visually sense a shadow of recesses (81) which will be described later. In this embodiment, the suction grill (60) is made of an off-white resin.

Figure 6:
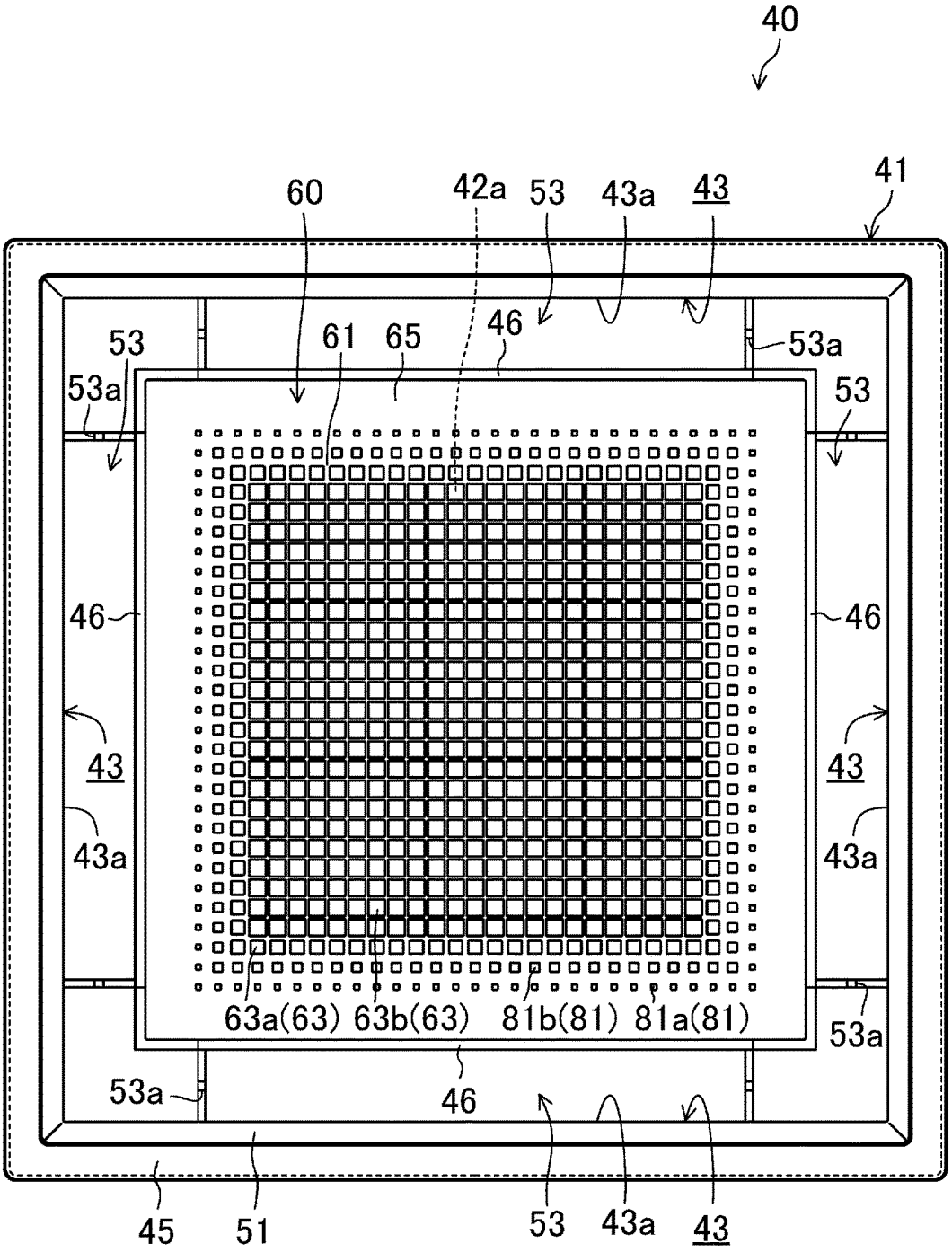
FIG. 6 is a view showing a decorative panel according to an embodiment as viewed from the indoor space.

As illustrated in FIG. 6, the grill body (61) has a generally square shape when viewed in plan. The grill body (61) is a grid-shaped one, and thus has a large number of suction holes (63). In this embodiment, 25 suction ports (63) are arranged both vertically and horizontally to form a 25×25 matrix. Each of the suction holes (63) is configured as a through hole that penetrates through the grill body (61) in its thickness direction (vertical direction). Each of the suction holes (63) is cut to have a square cross section (transverse section). The outermost ones of the suction holes (63*a*) are configured to have a narrower width than the other suction holes (63*b*) arranged inside them. That is to say, the grill body (61) is configured such that a surrounding wall forming the outermost suction holes (63*a*) is thicker than the one forming the other suction holes (63*b*) arranged inside them.

Figure 7:
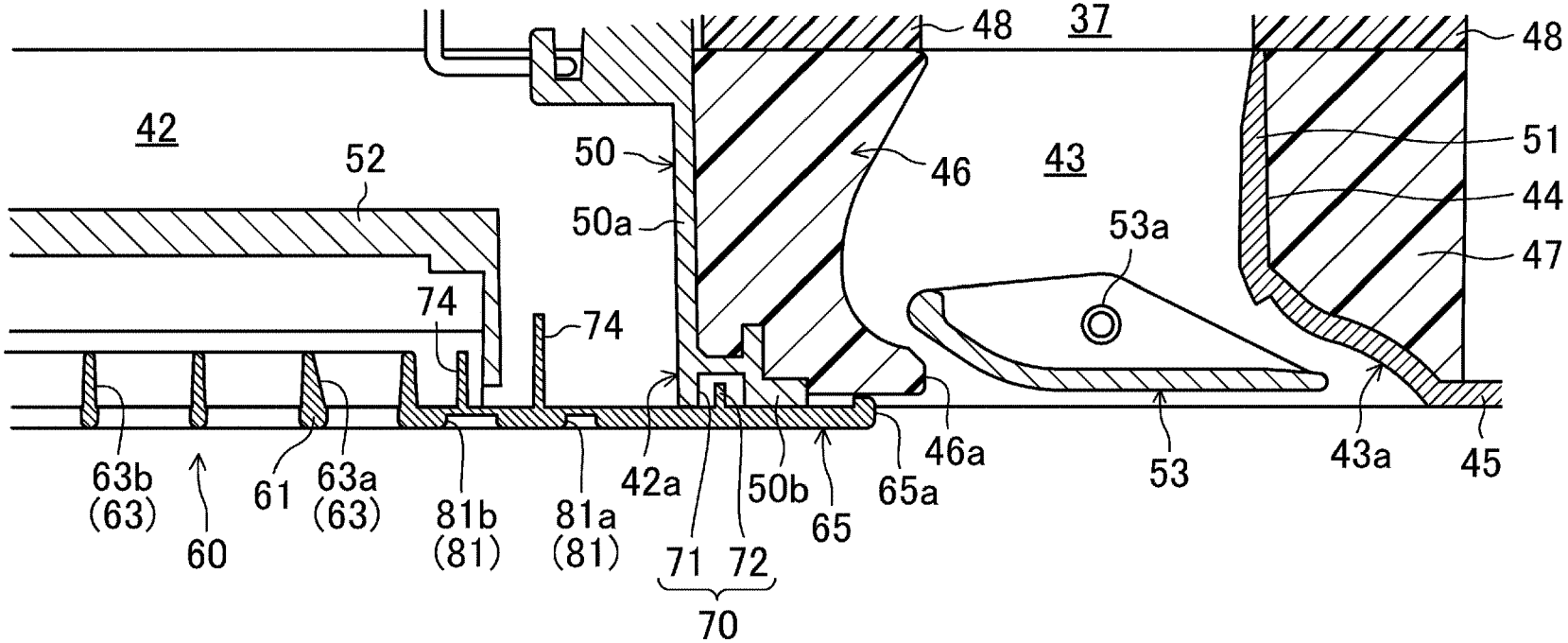
FIG. 7 is a partially enlarged view of FIG. 3.

As illustrated in FIGS. 3, 6, and 7, the extension (65) is configured as a plate body having a rectangular frame shape when viewed in plan, and extends outward from the entire periphery of the lower end of the grill body (61) to overlap with the lower surface of the panel body (41). In this embodiment, the extension (65) is provided to overlap with the respective lower surfaces of the inner heat insulating members (46) which form parts of the panel body (41). The extension (65) is also configured such that an end (65*a*) of the extension (65) extending toward the outlet ports (43*a*) is located closer to the suction port (42*a*) than the edges of the panel body (41) facing the outlet ports (43*a*), i.e., the respective outer edges (46*a*) of the inner heat insulating members (46). The end (65*a*) of the extension (65) is made thicker (i.e., to have a greater height in the vertical direction) than the rest thereof so as to be in contact with the respective lower surfaces of the inner heat insulating members (46). A kind of fiber to serve as a water-absorbing material which absorbs water is blown against, and fixed on, the respective lower surfaces of the inner heat insulating members (46). Thus, the end (65*a*) of the extension (65) is in contact with the respective lower surfaces of the inner heat insulating members (46) on which the water-absorbing material has been fixed.

The lower surface of the extension (65) has a large number of recesses (81) to improve the design of the suction grill (60). Those recesses (81) are arranged along the periphery of the grill body (61) to surround the grill body (61). In this embodiment, each of those recesses (81) has a square cross section (transverse section). The pitch at which the recesses (81) are arranged along the periphery of the grill body (61) (i.e., the interval between the respective centers of adjacent recesses (81)) is equal to the pitch at which the suction ports (63) of the grill body (61) are arranged (i.e., the interval between the respective centers of adjacent suction ports (63)). In this embodiment, two lines of recesses (81) are arranged on the periphery of the grill body (61) so as to be distributed along the grill body (61). The recesses (81*a*) forming the outer one of the two lines distributed along the grill body (61) have a smaller opening width than the recesses (81*b*) forming the inner line.

On the other hand, on the upper surface of the extension (65), formed are a protruding wall (72) functioning as a regulating portion (70) which regulates the flow of air from the four outlet ports (43*a*) toward the suction port (42*a*) as will be described later, and two reinforcing ribs (74, 74). The two reinforcing ribs (74, 74) are formed to protrude upward from the upper surface of the extension (65) so as to surround, and extend along, the grill body (61). The two reinforcing ribs (74, 74) are located over a portion of the extension (65) with the multitude of recesses (81).

<Regulating Portion>

As illustrated in FIG. 7, a regulating portion (70) which regulates the flow of the air from the four outlet ports (43*a*) toward the suction port (42*a*) is provided between the upper surface of the extension (65) and the lower surface of the panel body (41). The regulating portion (70) is comprised of four grooves (71), each of which is cut in the lower surface of the panel body (41) to extend along an associated one of the four outlet ports (43*a*), and protruding walls (72), each of which protrudes from the upper surface of the extension (65) into an associated one of the four grooves (71) to extend in the longitudinal direction of the groove (71).

As illustrated in FIGS. 5 and 7, each of the four grooves (71) is cut in the lower surface of an associated one of the four side portions of the rectangular frame-shaped inner panel member (50) of the panel body (41) to be parallel to an associated one of the four outlet ports (43*a*). Specifically, the rectangular frame-shaped inner panel member (50) includes a tubular partition wall (50*a*) extending vertically and having a generally square transverse section, and a generally rectangular frame-shaped extending portion (50*b*) extending outward from the entire periphery of the lower end of the partition wall (50*a*). The four grooves (71) are respectively provided for the four side portions of the extending portion (50*b*). Each of the four grooves (71) has a slightly larger longitudinal dimension than its associated outlet port (43*a*). On the other hand, in the lower surface of the extending portion (50*b*) of the rectangular frame-shaped inner panel member (50), four deep grooves (73) which are deeper than the grooves (71) are cut to allow adjacent grooves (71) to communicate with each other. The four deep grooves (73) make the four grooves (71) communicate with each other. That is to say, in the lower surface of the rectangular frame-shaped inner panel member (50), the four grooves (71) and the four deep grooves (73) constitute a single rectangular groove.

Each of the protruding walls (72) has a rectangular frame shape, and stands upward on the upper surface of the extension (65) toward the inside of an associated one of the four grooves (71). Each of the protruding walls (72) is configured to have a height that allows the protruding wall to be housed in the rectangular groove formed in the lower surface of the inner panel member (50) by the four grooves (71) and the four deep grooves (73). The protruding walls (72) are formed integrally with the suction grill (60).

<Flow of Air in the Indoor Unit>

When the indoor fan (27) is operated, the indoor air is sucked from the indoor space (R) into the impeller housing space (29*b*) of the indoor fan (27) through the multitude of suction holes (63) of the suction grill (60), the panel-side suction channel (42) of the panel body (41), and the inner space (31*a*) of the bell mouth (31). The air in the impeller housing space (29*b*) is transported by the impeller (30) of the indoor fan (27), and is blown radially outward through the gap between the hub (28) and the shroud (29). The air blown out from the indoor fan (27) exchanges heat with a refrigerant flowing through the indoor heat exchanger (32) when it passes through the indoor heat exchanger (32). Thus, the air passing through the indoor heat exchanger (32) is cooled when the indoor heat exchanger (32) functions as an evaporator (i.e., during a cooling operation), and is heated when the indoor heat exchanger (32) functions as a condenser (i.e., during a heating operation). Then, the air that has passed through the indoor heat exchanger (32) is distributed into the four body-side blowout flow channels (37) of the indoor unit body (21), flow downward through the four panel-side blowout flow channels (43) of the decorative panel (40), and blow into the indoor space (R) through the four outlet ports (43*a*).

In this embodiment, the outlet-side end (65*a*) of the extension (65) of the suction grill (60) is located closer to the suction port (42*a*) than the edge of the lower surface of the panel body (41) facing the outlet port (43*a*) (i.e., the outer edge (46*a*) of the inner heat insulating member (46)). Thus, the air blown out through the outlet port (43*a*) is not blown against the outlet-side end (65*a*) of the extension (65), but is blown into the indoor space (R).

Further, according to this embodiment, the suction grill (60) is not fitted in the suction port (42*a*), but is provided with the extension (65) which overlaps with the lower surface of the panel body (41) to cover the lower end of the suction port (42*a*). Thus, part of the air blown out through the outlet port (43*a*) may pass through the gap between the lower surface of the panel body (41) and the extension (65) of the suction grill (60) to flow into the suction port (42*a*) without being supplied into the indoor space (R). However, in this embodiment, the regulating portion (70) comprised of the grooves (71) and the protruding walls (72) is provided between the upper surface of the extension (65) of the suction grill (60) and the lower surface of the panel body (41). Thus, even if part of the air blown out through the outlet port (43*a*) flowed into the gap between the upper surface of the extension (65) of the suction grill (60) and the lower surface of the panel body (41), the air would collide against the protruding wall (72) standing in the groove (71) and would stagnate there. In this manner, the flow of the air from the outlet port (43*a*) toward the suction port (42*a*) is regulated.

<Design of Decorative Panel>

As described above, if the suction grill is configured to be fitted in the suction port of the panel body, a gap (a seam) will be left between a portion of the panel body surrounding the suction port and the suction grill, which will impair the design of the panel. Such a seam may be eliminated by, for example, making the suction grill larger than the suction port such that the suction grill is attached to the bottom of the panel body instead of fitting the suction grill in the suction port of the panel body. However, an outer periphery of the suction grill may reach the outlet port, which may possibly cause the cooling air blown out through the outlet port during the cooling operation to condense on the outer periphery of the suction grill.

Thus, in this embodiment, as shown in FIGS. 3, 5, and 6, the suction grill (60) is comprised of the grill body (61) positioned over the suction port (42*a*) and the extension (65) extending outward from the entire periphery of the grill body (61) to overlap with the lower surface of the panel body (41), and the suction grill (60) is not fitted in the suction port (42*a*), but is arranged to cover the lower end of the suction port (42*a*). Therefore, unlike the configuration in which the suction grill (60) is fitted in the suction port (42*a*), no gap (or seam) can be left between the portion of the panel body (41) surrounding the suction port (42*a*) (the inner panel member (50)) and the suction grill (60), which improves the design of the decorative panel (40). On the other hand, the extension (65) of the suction grill (60) is configured such that the outlet-side end (65*a*) of the extension (65) is located closer to the suction port (42*a*) than the edge of the lower surface of the panel body (41) facing the outlet port (43*a*) (i.e., the outer edge (46*a*) of the inner panel member (50)). Thus, cooling air blown out through the outlet port (43*a*) during a cooling operation is not blown against the outlet-side end (65*a*) of the extension (65), and thus the outlet-side end (65*a*) of the extension (65) is not cooled by the cooling air. This allows for reducing the condensation on the outer periphery of the suction grill (60).

Further, in this embodiment, the outlet-side end (65*a*) of the extension (65) is configured to be in contact with the lower surface of the inner heat insulating member (46) which forms part of the outlet port (43*a*) and to be located closer to the suction port (42*a*) than the outer edge (46*a*) facing the outlet port (43*a*). In other words, the outlet-side end (65*a*) of the extension (65) is provided at a position near the outlet port (43*a*) toward which the air is not blown. This brings the outline of the suction grill (60) closer to that of the outlet port (43*a*), thereby making the outline of the suction grill (60) inconspicuous. This also improves the design of the decorative panel (40).

Advantages of Embodiment

According to this embodiment, the suction grill (60) is provided with an extension (65) extending outward from the entire periphery of a grill body (61), which is positioned over a suction port (42*a*), so as to overlap with the lower surface of the panel body (41). This allows for easy provision of a suction grill (60) with improved design without leaving any seam. Further, the extension (65) of the suction grill (60) is configured such that the outlet-side end (65*a*) of the extension (65) is located closer to the suction port (42*a*) than the edge (46*a*) of the lower surface of the panel body (41) facing the outlet port (43*a*). Thus, cooling air blown through the outlet port (43*a*) is not blown against the outlet-side end (65*a*) of the extension (65), and thus the outlet-side end (65*a*) of the extension (65) is not cooled by the cooling air. This allows for reducing condensation on the outer periphery of the suction grill (60).

Also, according to this embodiment, the extension (65) of the suction grill (60) is configured such that the outlet-side end (65*a*) of the extension (65) is in contact with the lower surface of the heat insulator (46) which forms part of the outlet port (43*a*). Thus, the heat insulator (46) blocks heat transfer between the outlet-side end (65*a*) of the extension (65) and cooling air passing through the outlet port (43*a*), thereby preventing the cooling air from cooling the outlet-side end (65*a*) of the extension (65) too much. This allows for further reducing the condensation on the outer periphery of the suction grill (60). In addition, since the extension (65) is configured such that the outlet-side end (65*a*) of the extension (65) is located rather close to the outlet port (43*a*) to bring an outline of the suction grill (60) closer to an outline of the outlet port (43*a*), the outline of the suction grill (60) turns into an inconspicuous one. This allows for further design improvement.

Furthermore, according to this embodiment, the water-absorbing material which absorbs water is fixed onto the lower surface of the heat insulator (46). Thus, even if condensation occurred near the outlet port (43*a*), the water-absorbing material absorbs condensed water, thereby preventing the condensed water from permeating the heat insulator (46), and from forming a drop on the outlet-side end (65*a*) of the extension (65).

In addition, according to this embodiment, a regulating portion (70) which regulates the flow of air from the outlet port (43*a*) toward the suction port (42*a*) is provided between the upper surface of the extension (65) of the suction grill (60) and the lower surface of the panel body (41). This allows for preventing part of the air blown out through the outlet port (43*a*) from flowing into the suction port (42*a*) without being supplied into the room. As a result, decrease in the efficiency of the indoor unit including the decorative panel with the above-described configuration is minimized.

Besides, according to this embodiment, the regulating portion (70) is comprised of the groove (71) cut in the lower surface of the panel body (41) to extend along the outlet port (43*a*), and the protruding wall (72) protruding from the upper surface of the extension (65) into the groove (71) and extending in the longitudinal direction of the groove (71). This simple configuration allows for preventing part of the air blown out through the outlet port (43*a*) from flowing into the suction port (42*a*) without being supplied into the room.

On top of that, this embodiment provides an indoor unit for an air conditioning device including the decorative panel (40) which allows for improving the design of the suction grill and reducing condensation on the suction grill.

Other Embodiments

The above-described embodiments may be modified to have any of the configurations to be described below.

In the above-described embodiments, the end (65*a*) of the extension (65) of the suction grill (60) is configured to be in contact with the lower surface of the inner heat insulating member (46). However, the end (65*a*) of the extension (65) is not necessarily in contact with the lower surface.

In the above-described embodiments, a water-absorbing material is fixed onto the lower surface of the inner heat insulating member (46). However, the water-absorbing material does not have to be fixed there.

In the above-described embodiments, the regulating portion (70) is provided between the upper surface of the extension (65) of the suction grill (60) and the lower surface of the panel body (41) to regulate the flow of the air from the outlet port (43*a*) toward the suction port (42*a*). However, the regulating portion (70) may be omitted.

In the above-described embodiments, the four outlet ports (43*a*) are cut through the panel body (41) to surround the suction port (42*a*) provided in the center portion of the panel body (41). However, the number of the outlet ports (43*a*) is not limited thereto. Two, three, or four or more outlet ports may be provided around the suction port (42*a*). Alternatively, a single suction port (42*a*) and a single outlet port (43*a*) may be cut through the panel body (41).

In the above-described embodiments, the indoor unit (20) of the air conditioning device (1) is configured as a ceiling mounted indoor unit fitted in the opening (O) of the ceiling (U). However, the indoor unit (20) may be configured as a ceiling suspended indoor unit that is suspended from the ceiling so as to be arranged in the indoor space (R). Further, the ceiling suspended indoor unit (20) may include a box-shaped casing including a top panel, four side panels, and a bottom panel, and the bottom panel may be configured as the decorative panel (40) of the present invention. In that case, the top panel and the four side panels are provided for the indoor unit body (21). That is, the decorative panel (40) is provided at the bottom of the indoor unit body (21).

The embodiments described above are merely illustrative ones in nature, and do not intend to limit the scope of the present invention or applications or uses thereof.

INDUSTRIAL APPLICABILITY

As can be seen from the foregoing description, the present invention is useful for a decorative panel and an indoor unit for an air conditioning device including the decorative panel.

DESCRIPTION OF REFERENCE CHARACTERS

1 Air Conditioning Device
20 Indoor Unit
21 Indoor Unit Body
40 Decorative Panel
41 Panel Body
42*a* Suction Port
43*a* Outlet Port
46 Inner Heat Insulating Member (Heat Insulator)
46*a* Outer Edge (Edge)
60 Suction Grill
61 Grill Body
65 Extension
65*a* End of Extension
70 Regulating Portion
71 Groove
72 Protruding Wall

The invention claimed is:

1. A decorative panel for an air conditioning device, the decorative panel being attached to a bottom of an indoor unit body mounted on a ceiling, the indoor unit body including a casing which houses an indoor fan, an indoor heat exchanger arranged around the indoor fan, and a drain pan arranged below the indoor heat exchanger, the decorative panel comprising:

a panel body having a suction port and an outlet port and attached to a bottom of the casing; and a suction grill attached to the suction port of the panel body, wherein the panel body includes an inner panel member having a vertically extending partition wall that forms a panel-side suction channel inside the partition wall, and a heat insulator which is positioned between the suction port and the outlet port and which forms part of the outlet port, the suction grill includes a grill body positioned over the suction port, and an extension extending outward from an entire periphery of the grill body to overlap with a lower surface of the panel body beyond the partition wall, a distance from an end of a portion of the extension extending toward the outlet port to the suction port is smaller than a distance from the suction port to an edge of a lower surface of the heat insulator facing the outlet port, the vertically extending partition wall continuously extends along a vertically extending inner most surface of the heat insulator and ends at a portion of the extension, and the end of the portion of the extension extending toward the outlet port is in contact with the lower surface of the heat insulator, a lower most surface of the heat insulator of the panel body is positioned above a lower most surface of the panel body, and the end of the portion extending toward the outlet port that is in contact with the lower surface of the heat insulator is thicker than the other portion of the extension which overlaps with the lower surface of the panel body.

2. The decorative panel of claim 1, wherein the partition wall extends upward from a lower surface of the panel body.

3. The decorative panel of claim 1, wherein the extension extends further outward than the partition wall so that the extension overlaps with a lower most surface of the inner panel member.

4. The decorative panel of claim 1, wherein a water-absorbing material which absorbs water is fixed onto the lower surface of the heat insulator.

5. The decorative panel of claim 4, wherein a regulating portion which regulates a flow of air from the outlet port toward the suction port is provided between an upper surface of the extension and the lower surface of the panel body.

6. The decorative panel of claim 5, wherein the regulating portion is comprised of a groove cut in the lower surface of the panel body to extend along the outlet port, and a protruding wall protruding from the upper surface of the extension into the groove to extend in a longitudinal direction of the groove.

7. The decorative panel of claim 1, wherein a regulating portion which regulates a flow of air from the outlet port toward the suction port is provided between an upper surface of the extension and the lower surface of the panel body.

8. The decorative panel of claim 7, wherein the regulating portion is comprised of a groove cut in the lower surface of the panel body to extend along the outlet port, and a protruding wall protruding from the upper surface of the extension into the groove to extend in a longitudinal direction of the groove.

9. The decorative panel of claim 7, wherein the regulating portion is comprised of a groove cut in the lower surface of the panel body to extend along the outlet port, and a protruding wall protruding from the upper surface of the extension into the groove to extend in a longitudinal direction of the groove.

10. An indoor unit for an air conditioning device, the indoor unit comprising an indoor unit body mounted on a ceiling, and a decorative panel attached to a bottom of the indoor unit body, wherein the decorative panel comprises a panel body having a suction port and an outlet port and attached to a bottom of the casing; and a suction grill attached to the suction port of the panel body, wherein the panel body includes an inner panel member having a vertically extending partition wall that forms a panel-side suction channel inside the partition wall, and a heat insulator which is positioned between the suction port and the outlet port and which forms part of the outlet port, the suction grill includes a grill body positioned over the suction port, and an extension extending outward from an entire periphery of the grill body to overlap with a lower surface of the panel body beyond the partition wall, a distance from an end of a portion of the extension extending toward the outlet port to the suction port is smaller than a distance from the suction port to an edge of a lower surface of the heat insulator facing the outlet port, the vertically extending partition wall continuously extends along a vertically extending inner most surface of the heat insulator and ends at a portion of the extension, and the end of the portion of the extension extending toward the outlet port is in contact with the lower surface of the heat insulator, a lower most surface of the heat insulator of the panel body is positioned above a lower most surface of the panel body, and the end of the portion extending toward the outlet port that is in contact with the lower surface of the heat insulator is thicker than the other portion of the extension which overlaps with the lower surface of the panel body.

11. The indoor unit for an air conditioning device of claim 10, wherein a regulating portion which regulates a flow of air from the outlet port toward the suction port is provided between an upper surface of the extension and the lower surface of the panel body.

12. The indoor unit for an air conditioning device of claim 10, wherein a water-absorbing material which absorbs water is fixed onto the lower surface of the heat insulator.

13. The indoor unit for an air conditioning device of claim 12, wherein a regulating portion which regulates a flow of air from the outlet port toward the suction port is provided between an upper surface of the extension and the lower surface of the panel body.

14. A decorative panel for an air conditioning device, the decorative panel being attached to a bottom of an indoor unit body mounted on a ceiling, the indoor unit body including a casing which houses an indoor fan, an indoor heat exchanger arranged around the indoor fan, and a drain pan arranged below the indoor heat exchanger, the decorative panel comprising:

a panel body having a suction port and an outlet port and attached to a bottom of the casing; and a suction grill attached to the suction port of the panel body, wherein the panel body includes an inner panel member having a vertically extending partition wall that forms a panel-side suction channel inside the partition wall, and a heat insulator which is positioned between the suction port and the outlet port and which forms part of the outlet port, the suction grill includes a grill body positioned over the suction port, and an extension extending outward from an entire periphery of the grill body to overlap with a lower surface of the panel body beyond the partition wall, a distance from an end of a portion of the extension extending toward the outlet port to the suction port is smaller than a distance from the suction port to an edge of a lower surface of the heat insulator facing the outlet port, the vertically extending partition wall continuously extends along a vertically extending inner most surface of the heat insulator and ends at a portion of the extension, the end of the portion of the extension extending toward the outlet port is in contact with the lower surface of the heat insulator, and the inner panel member covers a portion of the heat insulator toward the suction port and the lower surface of the heat insulator, and the extension is positioned closer to the outlet port than an end of a portion of the inner panel member toward the outlet port.

15. The decorative panel of claim 14, wherein a lower most surface of the inner panel member is positioned below a lower most surface of the heat insulator, and the extension is in contact with the heat insulator.

* * * * *